US010136771B1

(12) United States Patent
Dykes

(10) Patent No.: US 10,136,771 B1
(45) Date of Patent: Nov. 27, 2018

(54) SHOWER HEATER SYSTEM AND METHOD

(71) Applicant: Donald D. Dykes, Reno, NV (US)

(72) Inventor: Donald D. Dykes, Reno, NV (US)

( * ) Notice: Subject to any disclaimer, the term of this patent is extended or adjusted under 35 U.S.C. 154(b) by 0 days.

(21) Appl. No.: 15/600,647

(22) Filed: May 19, 2017

(51) Int. Cl.
*A47K 10/48* (2006.01)

(52) U.S. Cl.
CPC ..... *A47K 10/48* (2013.01)

(58) Field of Classification Search
CPC ..... F26B 25/005; F26B 25/06; F26B 3/04; A47K 10/48; A47K 3/022
USPC ..... 34/476, 90; 4/597
See application file for complete search history.

(56) References Cited

U.S. PATENT DOCUMENTS 2,648,327 A * 8/1953 Gibbon ..... A61G 11/00 600/22
3,128,161 A * 4/1964 Hudon ..... A47K 10/48 239/587.4
3,419,915 A * 1/1969 Clark, Jr. ..... A61H 33/063 392/379
4,558,526 A * 12/1985 Baus ..... A45D 20/16 137/630.17
4,623,090 A * 11/1986 Heger ..... B60H 1/00471 236/49.1
4,683,668 A * 8/1987 Hondzinski ..... B60S 3/002 239/446
4,871,900 A * 10/1989 Hickman ..... A47K 10/48 34/202
5,099,587 A * 3/1992 Jarosch ..... A47K 10/48 34/202
5,930,912 A * 8/1999 Carder ..... A47K 10/48 34/202
6,148,539 A * 11/2000 Hatfield ..... A47K 10/48 34/223
6,351,603 B2 * 2/2002 Waithe ..... F24D 19/1051 392/465
6,805,458 B2 * 10/2004 Schindler ..... E03C 1/0412 239/18
6,941,677 B2 * 9/2005 Adrian ..... F24H 1/06 126/110 B (Continued)

FOREIGN PATENT DOCUMENTS

DE 3719041 A1 * 12/1988 ..... A62B 11/00

OTHER PUBLICATIONS

USPTO trademark search on TESS database for GFI on Jan. 24, 2018.*

*Primary Examiner* — Stephen M Gravini
(74) *Attorney, Agent, or Firm* — Kerr IP Group, LLC

(57) ABSTRACT

A shower heater system and method is described herein. The shower heater system includes a housing, a fan, a fan motor, a fan control, a fan outlet, a main temperature control component, a heater element, and a flexible hose. The housing has an exterior housing wall, a housing inlet, and a housing outlet. The fan outlet is coupled to a heater element inlet. The main temperature control component includes a heater control component disposed on the exterior housing wall. The heater control component has a first heater setting. The main temperature control component adjusts a heater element according to the first heater setting. The heater element is coupled to the heater element inlet. The heater element outlet is coupled to the heater element and the heater element outlet is coupled to the housing outlet. A flexible hose is coupled to the housing outlet.

18 Claims, 6 Drawing Sheets

(56) References Cited

U.S. PATENT DOCUMENTS

| | | | | |
|---|---|---|---|---|
| 6,962,005 | B1 * | 11/2005 | Khosropour | A47K 10/48 34/218 |
| 7,076,887 | B1 * | 7/2006 | Camberos | A47K 10/48 34/201 |
| 7,774,953 | B1 * | 8/2010 | Duran | A47K 10/48 239/54 |
| 7,900,371 | B1 * | 3/2011 | Bullard | A47K 10/48 34/202 |
| 8,438,753 | B2 * | 5/2013 | Martin | A47K 3/281 236/94 |
| 9,615,702 | B2 * | 4/2017 | Calpe Gargallo | A47K 10/48 |
| 9,638,463 | B2 * | 5/2017 | Cross | F26B 3/04 |
| 9,839,334 | B2 * | 12/2017 | Casla Arruiz | A47K 10/48 |
| 2005/0086735 | A1 * | 4/2005 | Lim | A47K 3/32 4/596 |
| 2011/0185493 | A1 * | 8/2011 | Chen | E03C 1/057 4/623 |
| 2016/0000273 | A1 * | 1/2016 | Shah | A47K 3/28 4/601 |

* cited by examiner

SHOWER HEATER SYSTEM AND METHOD

FIELD

The present disclosure relates to a wall mounted shower heating and drying system and method. More particularly, the present disclosure relates to a shower heating and drying system and method safe for use in a bathing area, and including a flexible hose to direct heated air to any portion of a bather's body and a surrounding bathing space.

BACKGROUND

A variety of stand-alone, ceiling mounted, and wall mounted drying apparatuses have been developed to air dry a bather. In part, these apparatuses aid in the reduction of water use. The United States Geological Survey estimates that each person uses about 80-100 gallons of water per day. The second largest component of a person's daily water use is bathing, accounting for 20-40 gallons of water per use. Water usage is particularly important in light of global warming concerns and in the sport vehicle setting, e.g., RVs, boats, and campers. For various reasons, existing drying apparatuses are not capable of both heating the shower and air drying the entire body of a wet bather safely, quickly, conveniently, and efficiently.

A drier is described in U.S. Pat. No. 3,128,161 for use in drying the entirety of a person's body after a shower or bath. The drier has an enclosure that is separate and distinct from the shower or bath with nozzles mounted on the interior. This requires bathers to exit the shower, which forces the bather to cover with a towel or bear the relatively cool air of the bathroom. Multiple nozzles are required because of the limited range and mobility of the nozzle fixtures.

A steam sauna is described in U.S. Pat. No. 4,833,739 that reduces the danger of scalding. The steam sauna utilizes fixed passageways to deliver steam to the sauna. The steam sauna mitigates the danger of scalding by delivering a constant flow of fresh air through the passageway as well. The fresh air temperature may be varied for comfort. In an alternative use, the steam sauna may provide only hot air through the passageways and thereby create a hot air sauna experience for the bather.

A vertical stand-alone dryer extension assembly is described in U.S. Pat. No. 7,814,677, which allows a wet bather to dry themselves by standing in front of the dryer extension assembly and rotating or maneuvering the bather's body as necessary.

A combination shower and body dryer that is mounted in the ceiling of a shower compartment is described in U.S. Patent Application No. 2007/0039199. The combination body and shower dryer delivers hot air through a fixed, immovable ceiling passageway.

A thermoelectric heating and cooling device is described in U.S. Patent Application No. 2008/0098750. The thermoelectric heating and cooling device may be used on water craft, RV's, other land, sea or air vehicles, or in the outdoors or in work areas where batteries or generators are commonly available. The heating and cooling device includes one or more hoses to deliver and return local source water, i.e., a lake or ocean.

A therapeutic shower used for weight reduction is described in U.S. Patent Application No. 2013/0226109. The therapeutic shower includes a hot air blower that directs hot air down from the ceiling of a shower enclosure through fixed and molded distribution channels.

Thus, there exists a need for a versatile drying system and method that allow a wet bather to pre-heat the shower, and direct a heated flow of air to all portions of a bather's body, such that a bather may safely, quickly, conveniently, and efficiently dry their entire body without leaving the warm comfort of the shower or using another drying apparatus, e.g., a towel.

SUMMARY

A shower heater system and method is described herein. The shower heater system includes a housing, a fan, a fan motor, a fan control, a fan outlet, a main temperature control component, a heater element, and a flexible hose. The housing has an exterior housing wall, a housing inlet, and a housing outlet. The fan is disposed within the housing. The fan motor is associated with the fan. The fan motor includes a fan inlet that is coupled to the housing inlet. The fan control component is disposed on the exterior housing wall. The fan control component includes a first fan setting that operatively controls the fan motor. The fan outlet is coupled to a heater element inlet. The main temperature control component includes a heater control component disposed on the exterior housing wall. The heater control component has a first heater setting. The main temperature control component adjusts a heater element according to the first heater setting. The heater element is coupled to the heater element inlet. The heater element outlet is coupled to the heater element and the heater element outlet is coupled to the housing outlet. A flexible hose is coupled to the housing outlet.

In one embodiment, the housing is a fixed housing that includes one or more fasteners for fastening the fixed housing to a shower. Additionally, the flexible hose that is coupled to the housing outlet is at least 2 feet in length.

In another embodiment, the shower heater system includes a Ground Fault Interrupt (GFI) that shuts off the shower heater when there is a current imbalance in the shower heater system.

In yet another embodiment, the shower heater system includes a second temperature controller that is electrically coupled to the main temperature control component. The second temperature controller includes a pre-set high temperature, which causes the shower heater system to automatically shut-off when the pre-set high temperature is exceeded.

In a further embodiment, the shower heater system includes an occupancy sensor that is operatively coupled to a timer. The timer is triggered when the occupancy sensor does not detect a bather near the shower heater system, and the shower heater system is automatically shut off, when the timer has expired and the occupancy sensor does not detect the bather.

In a still further embodiment, the shower heater system includes the second temperature controller that is electrically coupled to the main temperature control component and the occupancy sensor that is operatively coupled to a timer.

In an even further embodiment, the shower heater system includes the GFI, the second temperature controller that is electrically coupled to a main temperature control component, and the occupancy sensor that is operatively coupled to a timer.

FIGURES

The present invention will be more fully understood by reference to the following drawings which are presented for illustrative, not limiting, purposes.

DESCRIPTION

Persons of ordinary skill in the art will realize that the following description is illustrative and not in any way limiting. Other embodiments of the claimed subject matter will readily suggest themselves to such skilled persons having the benefit of this disclosure. It shall be appreciated by those of ordinary skill in the art that the apparatus, systems and methods described herein may vary as to configuration and as to details. The following detailed description of the illustrative embodiments includes reference to the accompanying drawings, which form a part of this application. The drawings show, by way of illustration, specific embodiments in which the invention may be practiced. It is to be understood that other embodiments may be utilized and structural changes may be made without departing from the scope of the claims.

A shower heater system and method is described that includes a housing, a fan, a fan motor, a fan control, a fan outlet, a main temperature control component, a heater element, and a flexible hose. The main temperature control component includes a heater control component disposed on an exterior housing wall. The heater control component has at least one heater setting. The main temperature control component adjusts a heater element according to the heater setting. The heater element is coupled to the heater element inlet. The heater element outlet is coupled to the heater element and the heater element outlet is coupled to the housing outlet. A flexible hose is coupled to the housing outlet. Shower, bath, and sauna are used interchangeably herein.

The shower heater system includes a variety of automatic shut-off systems such as a Ground Fault Interrupt (GFI) that shuts off the shower heater when there is a current imbalance in the shower heater system. A temperature based automatic shut-off system is also described that includes a second temperature controller that is electrically coupled to a main temperature control component. The second temperature controller includes a pre-set high temperature, which causes the shower heater system to automatically shut-off when the pre-set high temperature is exceeded. Additionally, a timer based automatic shut-off system includes an occupancy sensor that is operatively coupled to a timer. The timer is triggered when the occupancy sensor does not detect a bather near the shower heater system, and the shower heater system is automatically shut off, when the timer has expired and the occupancy sensor does not detect the bather.

Figure 1:
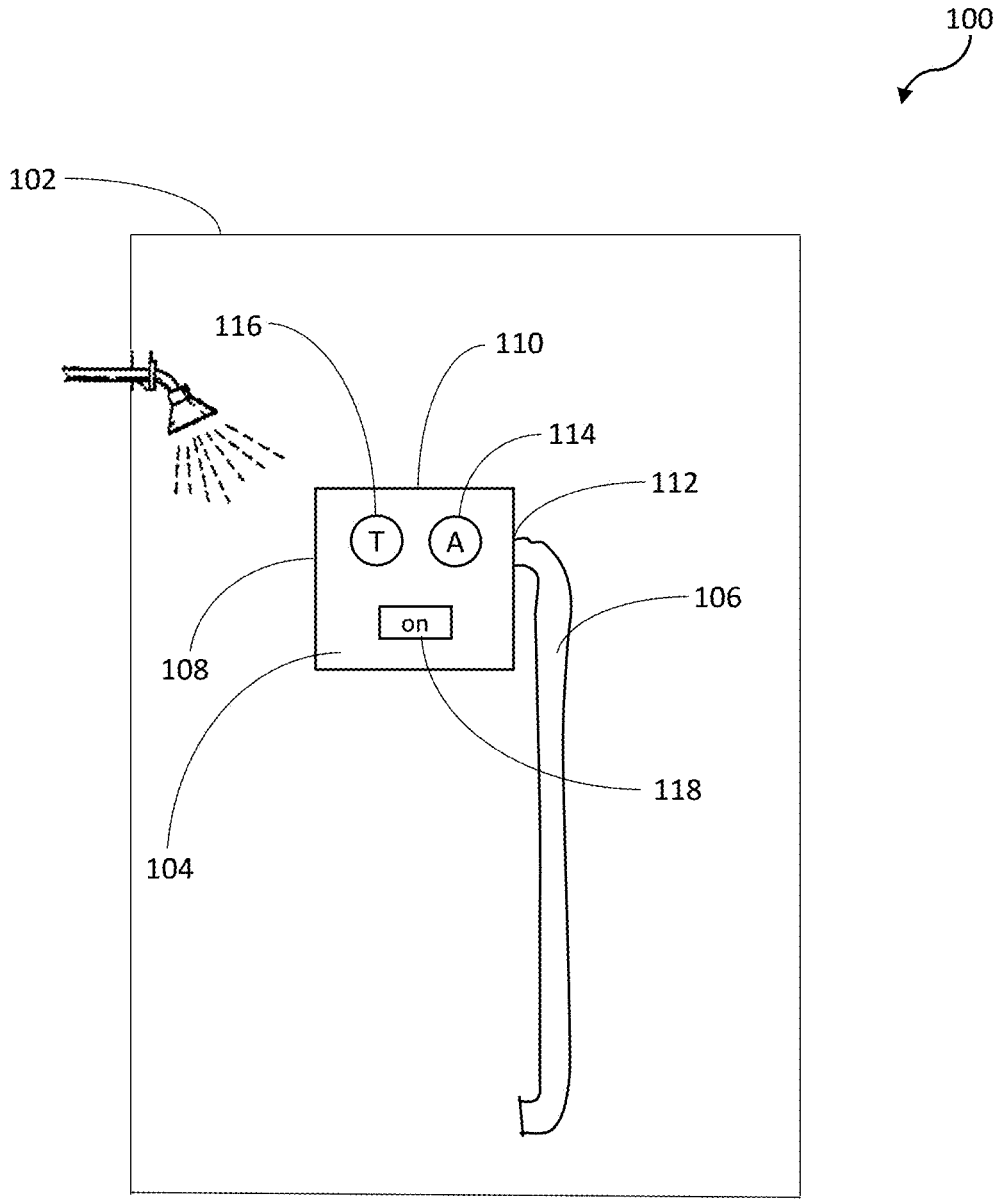
FIG. 1 shows a simplified view of the shower heater system installed in an illustrative shower.

Referring to FIG. 1, there is shown a simplified view of the shower heater system 100 installed in an illustrative shower 102. The shower heater system 100 includes a housing 104, a fan control component 114, a heater control component 116 and a flexible hose 106. The housing 104 has an exterior housing wall 108, a housing inlet 110, and a housing outlet 112.

The housing 104 is attached to the shower 102 at the exterior housing wall 108. A fan is disposed within the housing 104. The fan motor includes a fan inlet that is coupled to the housing inlet 110. There are three bather controls shown, namely, the fan control component 114, a heater control component 116, and an "on" button 118.

In one illustrative embodiment, the user enters the shower and pushes the "on" button to activate the shower heater 100. The user can adjust the fan control component 114 and heater control component 116 before activating the shower heater system 100, or after the shower heater system is activated by the pushing the "on" button.

Air is received from the housing inlet 110 and then is heated as it passes through the shower heater system 100. The heated air is delivered to the flexible hose 106 and the heated air is released through the flexible hose outlet. In addition to heating the shower, the flexible hose 106 can be used to dry hair, dry skin, clean the shower, and for other such applications.

In various embodiments, the shower heater system 100 may be located inside or outside the shower 102. In one embodiment, the housing 104 is disposed on a shower wall. In other embodiments, the shower heater system 100 may be built into the shower wall, the shower floor, or the shower ceiling. In still other embodiments, the shower heater system 100 may be built into a wall, floor, or ceiling of a bathing area, but outside the shower 102. In still further embodiments, the housing 104 may be disposed on a wall, floor, or ceiling of the bathing area, but outside the shower 102.

Figure 2:
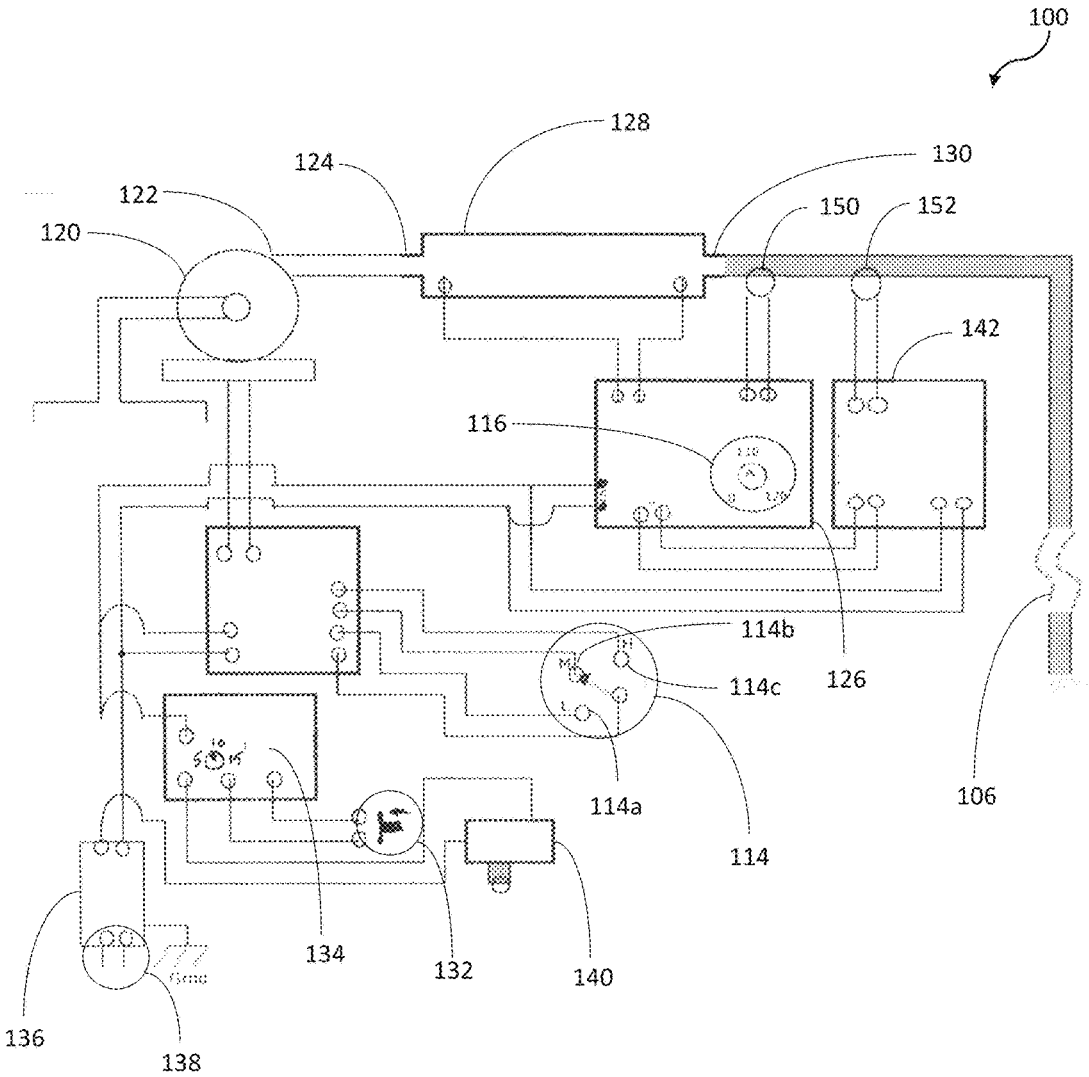
FIG. 2 shows a schematic of the various components of the shower heater system.

Referring to FIG. 2, there is shown a schematic of the various components of the shower heater system 100. The fan control component 114 is disposed on the exterior housing wall 108. The fan control 114 includes a variety of fan settings that operatively control the fan motor 120, which includes a fan.

In the illustrative embodiment, the fan control component 114 includes a switch with a "low" setting 114*a*, a "medium" setting 114*b*, and a "high" setting 114*c*. The fan outlet 122 is coupled to a heater element inlet 124, and the heater element inlet 124 is coupled to a heater element 128. The heater element 128 is electrically connected to a main temperature control component 126.

The main temperature control component 126 includes the heater control component 116 disposed on the exterior housing wall 108 and a first temperature sensor 150. The heater control component 116 has a first heater setting. The main temperature control component 126 adjusts the heater element 128 according to the first heater setting. A heater element outlet 130 is coupled to the heater element 128 and the heater element outlet 130 is coupled to the housing outlet 112. The hose 106 is coupled to the housing outlet 112.

The shower heater system 100 includes a push-button start 132 electrically connected to an adjustable time delay relay (ATDR) 134. The start-button or switch 132 may directly power-on the shower heater system 100, or may allow for a delayed start through the ATDR 134.

A ground fault interrupter (GFI) 136 is electrically connected to a power source 138 and the shower heater system 100, such that the GFI 136 may trip and shut-off power to the shower heater system 100 if the shower heater system 100 short circuits, overloads, or otherwise experiences a current imbalance. The GFI is capable of sensing and reacting to imbalances in the milliamp range by shutting off power to the shower heater system 100. An occupancy sensor 140 is electrically connected to the GFI 136 and the ATDR 134, which causes the shower heater system 100 to shut-off when a bather is not occupying the shower 102.

A GFI, also called ground fault circuit interrupter (GFCI) or residual current device (RCD), is a device that shuts off an electric power circuit when it detects that current is flowing along an unintended path, such as through water or a person. A GFI measures the current leaving one side of a power source (termed the "live wire" or "hot wire"), and compares it to current returning on the other (termed the "neutral" side/lead). If the measured currents are not within accepted error tolerances, then some of the current is leaking through an unwanted connection, and the GFI shuts the power off. GFIs are just one of the safety features of the presently disclosed subject matter used to reduce the risk of electric shock and prevent electrical fires.

Additionally, the housing 104 provides further safety features by enclosing the shower heating system 100 and shielding it from the damp environment of the shower and bathing area. The housing 104 may be constructed of plastic, composite, or any other suitable water-resistant and/or flame retardant material.

In various embodiments, the fan 120 operates at a variable fan speed or with a step switch fan speed. The bather adjustable fan 120 adjusts fan speed to increase or decrease the air flow.

The main temperature control 126 enables the process of controlling and changing the temperature in a space, e.g., a shower, by measuring the passage of heat energy in or out of the space and adjusting the temperature to achieve a desired temperature. Temperature control may be achieved with a control loop that constantly assesses the shower room temperature and controls the heater element 128 to increase or decrease the temperature according to the bather defined setting.

The heater element 128 may be an electrical resistor, a heating/cooling fluid compression system, or any other suitable energy source. The heater element 128 may operate to heat a surrounding area by convection, conduction, or radiation. A simple thermostat 150 may be used to switch the heater on or off. Generally, a temporary overshoot and undershoot of the temperature may be expected.

By way of example and not of limitation, the main temperature control 126 enables controlling the shower temperature between 100° F. and 120° F. with an illustrative waterproof control knob. In various embodiments, the main temperature control 126 enables controlling the shower temperature between 90° F. and 130° F.

In other embodiments, the thermostat may use proportional control, which would vary the amount of heating provided by the heater element 128 depending on the difference between the bather defined temperature setting and the temperature measured at the first temperature sensor 150, which minimizes the amount of overshoot or undershoot. Alternatively, a wireless temperature sensor (not shown) may be positioned in a location outside of the housing 104 and may wirelessly communicate with shower heater system 100 using wireless technologies such as Bluetooth, Bluetooth Low Energy, Wi-Fi and other such wireless standards.

Additionally, more sophisticated control loops may use proportional-integral-derivative (PID) controllers. A PID controller is a control loop feedback mechanism (i.e., controller) that continuously calculates an error value, X, as the difference between a desired temperature and a measured temperature. The PID controller applies a correction based on proportional, integral, and derivative terms, which are summed to yield a variable value known in the industry as a manipulated variable (MV).

In the illustrative embodiment, the shower heater system 100 further includes a second temperature control 142. The second temperature control 142 is electrically coupled to the main temperature control component 126. The second temperature control 142 includes a pre-set high temperature, which causes the shower heater system 100 to automatically shut-off when the pre-set high temperature is exceeded.

The second temperature control 142 is electrically connected to a second temperature sensor 152 with an overshoot temperature safety shut-down that provides an automated shut-off for the main temperature control 126. The second temperature sensor 152 may be operatively coupled to an over temperature safety shut-down so that the temperature does not exceed a specific "high" temperature, e.g., 130° F.

If the temperature measured by the second temperature sensor 152 exceeds the specific high temperature, then the shower heater system 100 is shut-down temporarily or possibly permanently. For example, if the second temperature sensor 152 detects that the temperatures has reached a safe level, e.g. 100° F., then the second control system 142 may allow the main temperature control 126 to provide temperature control of the shower environment. However, if the second control system 142 has automatically initiated shut-down multiple times, e.g., 10 times, within a specific period of time, e.g., 15 minutes, then the shower heater 100 may be shut-down permanently so that it may be serviced professionally.

In the illustrative embodiment, the occupancy sensor 140 will trigger a shower heater 100 shut-down when a person is not in the shower 102 for a certain period of time. The shower heater system 100 is automatically shut-off when the timer has expired and the occupancy sensor 134 does not detect the bather.

Thus, the occupancy sensor 140 includes a time delay, and this time delay may be the ATDR 134. The ATDR may include a switch, knob, touch screen, or other suitable bather interface. The occupancy sensor 140 may be a passive infrared sensor, a microwave emitter/detector, an ultrasonic sensor, a video camera with appropriate software, or other photodetectors.

In various embodiments, the occupancy sensor 140 is electrically coupled to the ATDR 134 so that when a person is NOT detected in the shower 102, the ATDR 134 starts to countdown, e.g., 5 minutes. If the occupancy sensor 140 does detect a person in the shower 102 then the ATDR 134 remains in the pre-countdown state.

In the illustrative embodiment, a bather pushes the "on" button 118 to start the shower heater system 100. However, the shower heater system 100 may be turned on by other means such as a voice command or a switch located at the entrance of the shower door.

Additionally, the shower heater 100 may be turned on by locating a bather within the shower 102, by means of the occupancy senor 140. By pressing the "on" button 118, the bather starts an ATDR 134 and the ATDR 134 begins timing out. Thus, a pre-set timer starts counting down when the shower heater system 100 is turned on.

The hose 106 is flexible and may include a 90° fitting that delivers air to the bottom area of the shower 102 and causes the hot air to mix within the shower 102.

Figure 3A:
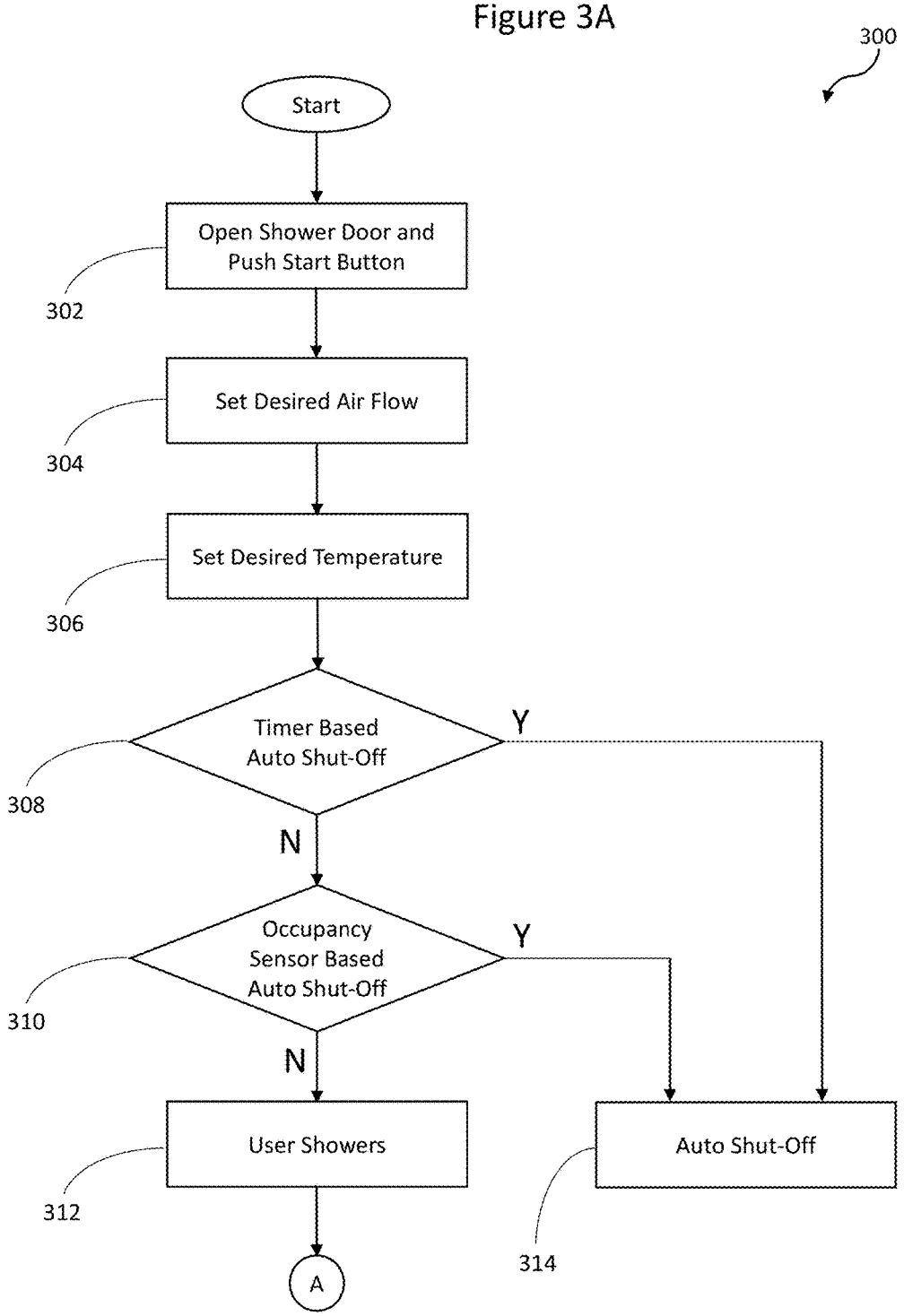
FIG. 3A and FIG. 3B shows an illustrative flowchart of a method of operation of the shower heater system.

Referring now to FIG. 3A, there is shown an illustrative method 300 of using the illustrative shower heater system 100. At step 302, a bather pushes the start button 118 to start the shower heater system 100. At step 304, the bather sets a desired air flow through the fan control component 114, to begin a flow of heated air into the shower 102.

At step 306, the bather sets a desired temperature through the heater control component 116, to set an upper limit for the interior shower temperature. At decision diamond 308, the bather may initiate a timer-based automatic shut-off at the ATDR 136. Once initiated, the ATDR 136 will countdown the selected amount of time and, at step 314 automatically shut-off the shower heater system 100.

At decision diamond 310, the bather activates an occupancy-based automatic shut-off. When in operation, at step 314, the occupancy sensor causes the shower heater system 100 to automatically shut-off when the bather is not detected within the shower 102.

At step 312, the ATDR has not shut-off the shower heater system 100, allowing the bather to enter the shower 102, trigger the occupancy sensor, and shower in a pre-heated shower 102 with additional heat provided as desired by the shower heater system 100.

In other embodiments, the bather may enter the shower 102 to trigger the occupancy sensor 140. Once triggered by the presence of a bather, the occupancy sensor 140 will power-on the shower heater system 100. The shower heater system 100 remains powered on while the bather is within the shower 102 triggering the occupancy sensor 140. The shower heater system 100 automatically shuts down when the bather exits the shower 102 and the occupancy sensor 140 ceases to register the presence of the bather in the shower 102. In this embodiment, the bather may set the ATDR to shut-off the shower heater system 100 at a specified amount time after the bather exits the shower 102, e.g., 5 minutes.

Figure 3B:
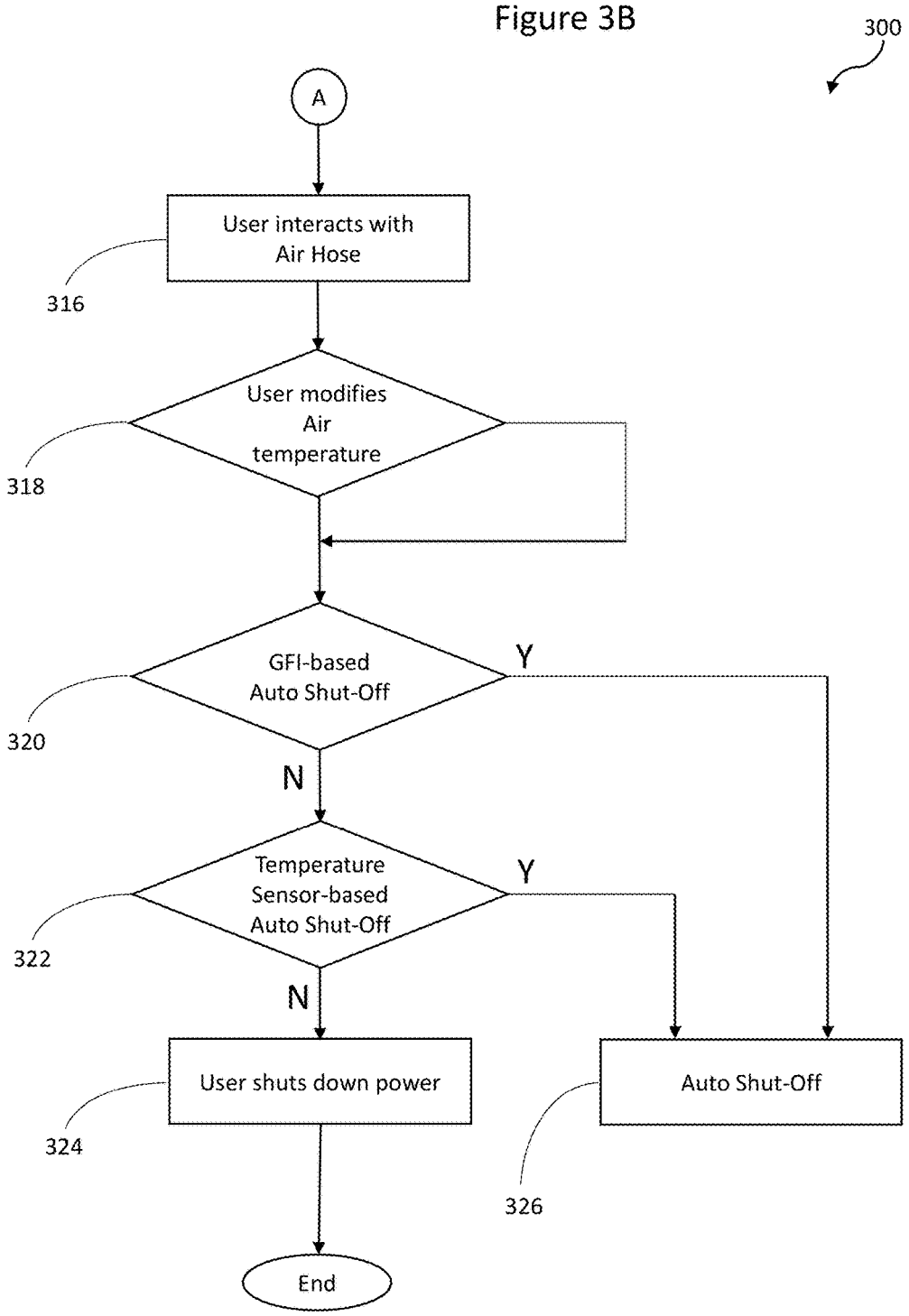

Referring now to FIG. 3B, method 300 continues at step 316, where the bather interacts with the air hose. In step 316, the bather may grasp the air hose 106 and direct the heated air to a portion of the shower 102 or the bather's body as desired. At decision diamond 318, the bather interacts with the heater control component 116 to select a desired temperature of the heated air. At decision diamond 320, the GFI 136 engages in the event of a current imbalance in the shower heater system 100, and initiates an automatic shutdown of the shower heater system 100 at step 326.

At decision diamond 322, the main temperature control 126 receives input from the first temperature sensor 150. If the temperature measured at the first temperature sensor 150 is above a predetermined threshold then the main temperature control 126 shuts off the shower heater system 100. At step 324, the bather manually shuts off power to the shower heater system 100.

Figure 4:
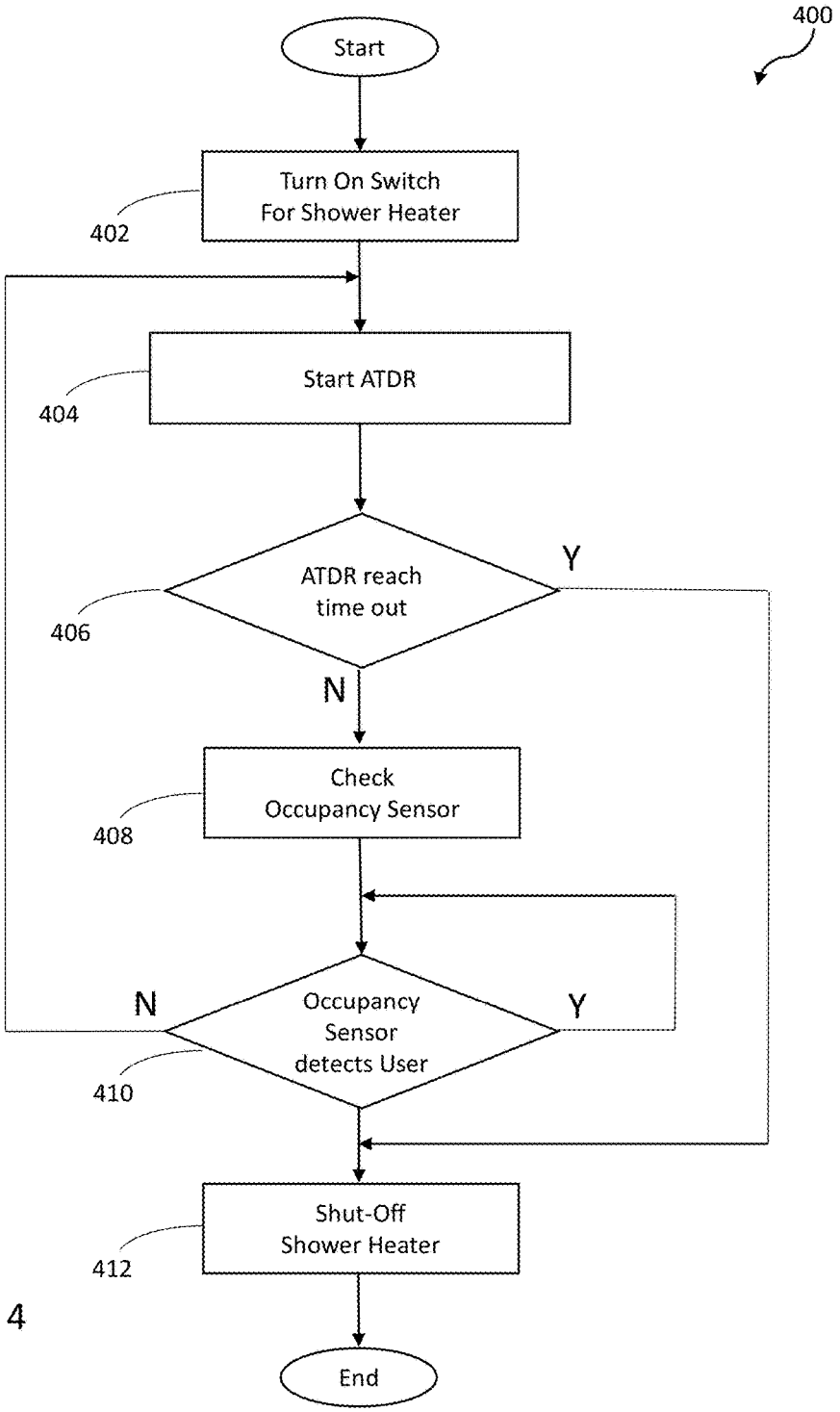
FIG. 4 shows an illustrative flowchart of the operation of the occupancy sensor and ATDR.

Referring now to FIG. 4, there is shown illustrative method 400 of operating the shower heater system 100. The method is initiated at step 402, where the start button 118 is engaged and the shower heater system 100 powers on. At step 404, the ATDR 134 begins counting down for an amount of time, e.g., 5 minutes, specified by the bather.

At decision diamond 406, the ATDR 134 either reaches the specified amount of time and causes the shower heater system 100 to shut-down at step 412, or the ATDR 134 continues to count down and allow the shower heater system 100 to continue to operate. At step 408, the shower heater system 100 receives occupancy sensor input from the occupancy sensor 140.

If the bather remains in the shower 102, the occupancy sensor 140 registers the bather and the shower heater system 100 continues to operate subject to the ATDR countdown. If the bather has exited the shower 102, the occupancy sensor 140 registers no bather and the shower heater system 100 shuts down at step 412.

Figure 5:
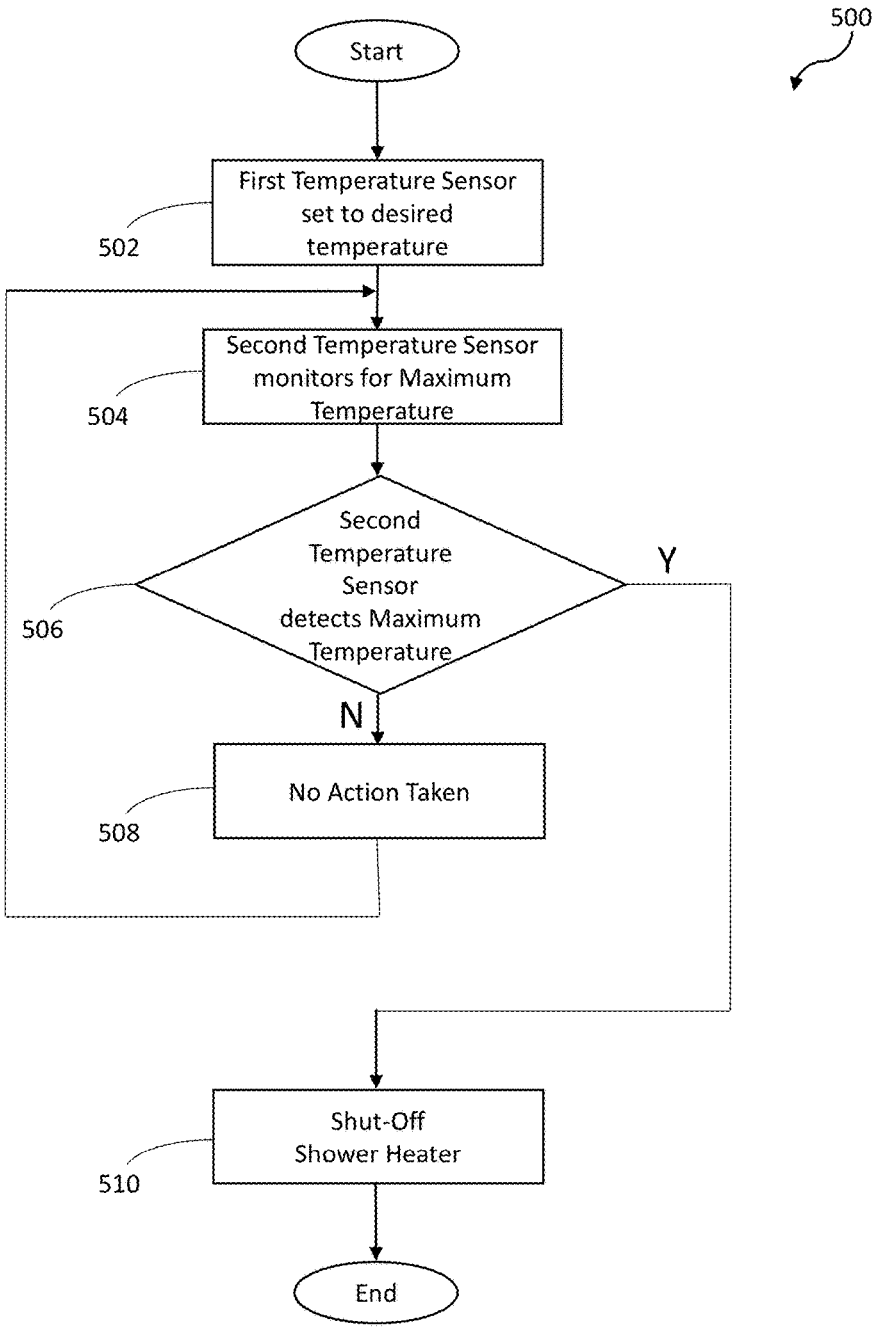
FIG. 5 shows an illustrative flowchart of a shower temperature-triggered automatic shut-off.

Referring now to FIG. 5, there is shown a method 500 of shower temperature-triggered automatic shut-down. The method is initiated at step 502 where the heater control component 116 is set to a desired temperature, which temperature is measured at the first temperature sensor 150.

At step 504, the second temperature sensor 152 monitors the air flow downstream of the first temperature sensor 150 for a maximum shower temperature. At decision diamond 506 the second temperature sensor 152 detects the shower temperature.

If the second temperature sensor 152 detects a temperature that is greater than the preset maximum temperature, then the second temperature control 142 shuts off the shower heater system 100. The preset maximum temperature may be a fixed temperature or a narrow adjustable temperature range, e.g., 130° F., 130° F.-135° F., or 130° F.-131° F. If the second temperature sensor 152 detects a temperature that is less than the preset maximum temperature, then the second temperature control 142 takes no action and allows the shower heater system 100 to continue to operate.

A shower heater system and method has been described. The shower heater system includes a variety of automatic shut-off systems. The automatic shut-off systems include a GFI, a temperature based automatic shut-off system that includes a second temperature controller having a pre-set high temperature, and a timer based automatic shut-off system including an occupancy sensor that is operatively coupled to a timer.

It is to be understood that the detailed description of illustrative embodiments are provided for illustrative purposes only. Thus, the shower heater system and method presented above may evolve to benefit from the improved performance and lower cost of the future hardware components that meet the system and method requirements presented. The scope of the claims is not limited to these specific embodiments or examples. Therefore, various process limitations, elements, details, and uses may differ from those just described, or be expanded on or implemented using technologies not yet commercially viable, and yet still be within the inventive concepts of the present disclosure. The scope of the invention is determined by the following claims and their legal equivalents.

What is claimed is:

1. A shower heater system comprising:

a housing having an exterior housing wall, a housing inlet and a housing outlet, the housing disposed on a shower wall;

a fan disposed within the housing;

a fan motor associated with a fan, wherein the fan motor includes a fan inlet that is coupled to the housing inlet;

a fan control component disposed on the exterior housing wall, wherein the fan control component includes a first fan setting that operatively controls the fan motor;

a fan outlet that is coupled to a heater element inlet;

a main temperature control component that includes a heater control component disposed on the exterior housing wall, the heater control component having a first heater setting, wherein the main temperature control component adjusts a heater element according to the first heater setting, the heater element coupled to the heater element inlet;

a heater element outlet coupled to the heater element, the heater element outlet is coupled to the housing outlet; and a flexible hose coupled to the housing outlet.

2. The shower heater system of claim 1 further comprising a Ground Fault Interrupt (GFI) that shuts off the shower heater when there is a current imbalance in the shower heater system.

3. The shower heater system of claim 1 wherein the housing is a fixed housing that includes one or more fasteners for fastening the fixed housing to a shower area.

4. The shower heater system of claim 3 wherein the flexible hose that is coupled to the housing outlet is at least 2 feet in length.

5. The shower heater system of claim 1 further comprising a second temperature controller that is electrically coupled to a main temperature controller component, wherein the second temperature controller component includes a pre-set high temperature, which causes the shower heater system to automatically shut-off when the pre-set high temperature is exceeded.

6. The shower heater system of claim 1 further comprising an occupancy sensor that is operatively coupled to a timer, wherein the timer is triggered when the occupancy sensor does not detect a bather near the shower heater system, and the shower heater system is automatically shut-off, when the timer has expired and the occupancy sensor does not detect the bather.

7. The shower heater system of claim 1 further comprising:

a second temperature controller that is electrically coupled to a main temperature controller component, wherein the second temperature controller component includes a pre-set high temperature, which causes the shower heater system to automatically shut-off when the pre-set high temperature is exceeded; and an occupancy sensor that is operatively coupled to a timer, wherein the timer is triggered when the occupancy sensor does not detect a bather near the shower heater system, and the shower heater system is automatically shut-off, when the timer has expired and the occupancy sensor does not detect the bather.

8. A shower heater system comprising:

a housing having an exterior housing wall, a housing inlet and a housing outlet, the housing disposed on a shower wall;

a fan disposed within the housing;

a fan motor associated with a fan, wherein the fan motor includes a fan inlet that is coupled to the housing inlet;

a fan control component disposed on the exterior housing wall, wherein the fan control component includes a first fan setting that operatively controls the fan motor;

a fan outlet that is coupled to a heater element inlet;

a main temperature control component that includes a heater control component disposed on the exterior housing wall, the heater control component having a first heater setting, wherein the main temperature control component adjusts a heater element according to the first heater setting, the heater element coupled to the heater element inlet;

a heater element outlet coupled to the heater element, the heater element outlet is coupled to the housing outlet;

an occupancy sensor that is operatively coupled to a timer, wherein the timer is triggered when the occupancy sensor does not detect a bather near the shower heater system, and the shower heater system is automatically shut-off, when the timer has expired and the occupancy sensor does not detect the bather; and a second temperature controller that is electrically coupled to a main temperature controller component, wherein the second temperature controller component includes a pre-set high temperature, which causes the shower heater system to automatically shut-off when the pre-set high temperature is exceeded.

9. The shower heater system of claim 8 further comprising a Ground Fault Interrupt (GFI) that shuts off the shower heater when there is a current imbalance in the shower heater system.

10. The shower heater system of claim 8 wherein the housing is a fixed housing that includes one or more fasteners for fastening the fixed housing to a shower area.

11. The shower heater system of claim 10 wherein the flexible hose that is coupled to the housing outlet is at least 2 feet in length.

12. A method for using a shower heater comprising:

providing a housing having an exterior housing wall, a housing inlet and a housing outlet, wherein the housing disposed on a shower wall;

receiving air from the housing inlet that is transferred to a fan inlet;

controlling a fan motor with a fan control component that is disposed on the exterior housing wall, wherein the fan control component includes a first fan setting that operatively controls the fan motor that receives air from the fan inlet;

transferring the air from the fan motor to a fan outlet, which is coupled to a heater element inlet;

heating the air received from the heater element inlet with a heater element;

adjusting the heater element according to a first heater setting, wherein the heater element is operatively coupled to a main temperature control component that includes a heater control component disposed on an exterior housing wall that receives the first heater setting;

generating a heated air that is transferred to a heater element outlet that is coupled to the housing outlet that is coupled to a flexible hose; and shutting off the shower heater with an occupancy sensor that is operatively coupled to a timer, wherein the timer is triggered when the occupancy sensor does not detect a bather near the shower heater system, and the shower heater system is automatically shut-off, when the timer has expired and the occupancy sensor does not detect the bather.

13. The shower heater method of claim 12 wherein the housing is a fixed housing that includes one or more fasteners for fastening the fixed housing to a shower area.

14. The shower heater method of claim 12 wherein the flexible hose that is coupled to the housing outlet is at least 2 feet in length.

15. The shower heater method of claim 12 further comprising shutting off the shower heater with a Ground Fault Interrupt (GFI), when there is a current imbalance in the shower heater system.

16. The shower heater method of claim 12 further comprising shutting off the shower heater an occupancy sensor that is operatively coupled to a timer, wherein the timer is triggered when the occupancy sensor does not detect a bather near the shower heater system, and the shower heater system is automatically shut-off, when the timer has expired and the occupancy sensor does not detect the bather.

17. The shower heater method of claim 12 further comprising:

shutting off the shower heater with a second temperature controller that is electrically coupled to a main temperature controller component, wherein the second temperature controller component includes a pre-set high temperature, which causes the shower heater system to automatically shut-off when the pre-set high temperature is exceeded; and shutting off the shower heater with an occupancy sensor that is operatively coupled to a timer, wherein the timer is triggered when the occupancy sensor does not detect a bather near the shower heater system, and the shower heater system is automatically shut-off, when the timer has expired and the occupancy sensor does not detect the bather.

18. The shower heater method of claim 12 further comprising:

shutting off the shower heater with a Ground Fault Interrupt (GFI), when there is a current imbalance in the shower heater system;

shutting off the shower heater with a second temperature controller that is electrically coupled to a main temperature controller component, wherein the second temperature controller component includes a pre-set high temperature, which causes the shower heater system to automatically shut-off when the pre-set high temperature is exceeded; and shutting off the shower heater with an occupancy sensor that is operatively coupled to a timer, wherein the timer is triggered when the occupancy sensor does not detect a bather near the shower heater system, and the shower heater system is automatically shut-off, when the timer has expired and the occupancy sensor does not detect the bather.

* * * * *